US009422912B2

(12) United States Patent
Schremmer

(10) Patent No.: US 9,422,912 B2
(45) Date of Patent: Aug. 23, 2016

(54) METHOD FOR CONTROLLING A CORONA IGNITION DEVICE

(71) Applicant: BorgWarner BERU Systems GmbH, Ludwigsburg (DE)

(72) Inventor: Torsten Schremmer, Ludwigsburg (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 174 days.

(21) Appl. No.: 14/291,230

(22) Filed: May 30, 2014

(65) Prior Publication Data

US 2014/0358399 A1 Dec. 4, 2014

(30) Foreign Application Priority Data

Jun. 3, 2013 (DE) ..... 10 2013 105 682

(51) Int. Cl.

| | |
|---|---|
| ***H01T 13/50*** | (2006.01) |
| ***F02P 17/00*** | (2006.01) |
| ***F02P 9/00*** | (2006.01) |
| ***F02P 15/04*** | (2006.01) |
| ***F02P 17/12*** | (2006.01) |
| ***F02P 23/04*** | (2006.01) |
| *F02P 15/08* | (2006.01) |

(52) U.S. Cl.

CPC ..... *F02P 17/00* (2013.01); *F02P 9/002* (2013.01); *F02P 15/04* (2013.01); *F02P 17/12* (2013.01); *F02P 23/04* (2013.01); *H01T 13/50* (2013.01); *F02P 15/08* (2013.01)

(58) Field of Classification Search

CPC ..... H01T 13/50; F02P 9/002; F02P 9/007; F02P 23/04

USPC ..... 123/143 B, 606–608

See application file for complete search history.

(56) References Cited

U.S. PATENT DOCUMENTS

| | | | | |
|---|---|---|---|---|
| 2011/0114071 | A1 | 5/2011 | Freen | |
| 2013/0049601 | A1 | 2/2013 | Bohne et al. | |
| 2013/0319384 | A1* | 12/2013 | Trump | F02P 3/01 123/623 |
| 2014/0123924 | A1* | 5/2014 | McAlister | F02M 57/06 123/143 B |

FOREIGN PATENT DOCUMENTS

| | | | |
|---|---|---|---|
| DE | 10 2010 044 845 | B3 | 12/2011 |
| DE | 10 2011 053 169 | A1 | 2/2013 |
| WO | WO 2010/011838 | A1 | 1/2010 |

* cited by examiner

*Primary Examiner* — Erick Solis

(74) *Attorney, Agent, or Firm* — Bose McKinney & Evans LLP

(57) ABSTRACT

The invention relates to a method for controlling a corona ignition device that has a high-frequency generator and a resonant circuit that contains an ignition electrode, wherein a primary voltage is fed into the high-frequency generator, the resonant circuit is excited by a secondary voltage generated by the high-frequency generator, and a corona discharge is thus produced at the ignition electrode, a series of values of an electric variable are measured during the excitation of the resonant circuit, it is checked, by evaluating the measured values, whether the corona discharge has transitioned into an arc discharge, and a determination of an arc discharge is responded to by reducing the secondary voltage and thus extinguishing the arc discharge.

18 Claims, 3 Drawing Sheets

METHOD FOR CONTROLLING A CORONA IGNITION DEVICE

RELATED APPLICATIONS

This application claims priority to DE 10 2013 105 682.2, filed Jun. 3, 2013, which is hereby incorporated herein by reference in its entirety.

BACKGROUND

The invention relates to a method for controlling a corona ignition device comprising a high-frequency generator and a resonant circuit that contains an ignition electrode.

WO 2010/011838 A1 discloses a corona ignition device with which a fuel/air mixture in a combustion chamber of an internal combustion engine can be ignited by a corona discharge produced in the combustion chamber. This corona ignition device comprises an ignition electrode inserted in an insulator. The ignition electrode forms an electric capacitor together with the insulator and a sleeve surrounding the insulator. This capacitor is part of an electric resonant circuit of the corona ignition device, said circuit being excited by a high-frequency AC voltage. A voltage excess is thus produced at the ignition electrode, such that a corona discharge is formed at said electrode.

The corona discharge should not break down into an arc discharge or spark discharge. Care is therefore taken to ensure that the voltage between the ignition electrode and ground remains below the breakdown voltage. To this end, the primary-side impedance of a high-frequency generator, which generates the high-frequency AC voltage from a primary voltage, is set to a target value. In order to operate the corona ignition device with the best target value possible, a given target value is checked at predefined intervals by being increased in steps from engine cycle to engine cycle until an arc discharge ultimately occurs. If an arc discharge is detected, the target value for subsequent engine cycles is reduced by a predefined percentage.

In order to generate the best corona discharge possible, corona discharge devices are generally operated just below the breakdown voltage. The closer the voltage at the ignition electrode is to the breakdown voltage, the greater is the corona discharge. However, an increase of the voltage to the breakdown voltage is to be avoided, since an arc discharge then forms instead of the corona discharge. Arc discharges cause increased burn-up of the ignition electrode and lead to a poorer combustion or ignition of the fuel/air mixture in the combustion chamber of the engine.

In corona ignition devices, a creeping discharge may occur instead of a corona discharge, or a spark or creeping discharge forms during a corona discharge. It is known from DE 10 2011 053 169 A1 that malfunctions of this type can be recognized on a characteristic profile of an electric variable. Specifically, periodic fluctuations of the secondary voltage often occur as a precursor of serious malfunctions, in particular internal spark or creeping discharges. If fluctuations of this type are detected, malfunctions can be identified early, before they lead to a serious malfunction.

SUMMARY

This disclosure teaches how the service life of corona ignition devices can be improved.

With a method according to this disclosure, the corona discharge is monitored continuously during operation of the corona ignition device in order to ascertain whether it has transitioned into an arc discharge. If an arc discharge is detected, the secondary voltage is reduced and the arc discharge is thus extinguished. The duration of any arc discharge is thus minimized and the burn-up of the ignition electrode is reduced.

Arc discharges cannot be completely avoided during extended operation of a corona ignition device. An arc discharge may form occasionally as a result of faults, unanticipated changes in the breakdown voltage, for example due to changes in the fuel/air mixture, or voltage fluctuations of the on-board supply. In known systems, the voltage is merely reduced in subsequent engine cycles whenever an arc discharge is detected and thus the formation of an arc discharge prevented only in subsequent engine cycles. Instead, this disclosure teaches how to correct the voltage already in the current engine cycle. With a control method according to this disclosure, the secondary voltage is reduced in response to a detection of an arc discharge and the arc discharge is extinguished. As a consequence of detection of an arc discharge, the secondary voltage is reduced such that the arc discharge extinguishes.

In an advantageous refinement of this disclosure, the secondary voltage is reduced by switching off the high-frequency generator. By switching off the high-frequency generator, the secondary voltage can be reduced and the arc discharge thus extinguished very easily and very quickly.

In a further advantageous refinement of this disclosure, the method is carried out with the engine running. If an arc discharge has been extinguished, the secondary voltage is increased again during the same engine cycle and a corona discharge is thus created. The fuel/air mixture present in the combustion chamber of the engine can thus still be ignited in this engine cycle in spite of the occurrence of an arc discharge and rapid extinguishing thereof. Once an arc discharge has been extinguished, the secondary voltage is preferably increased only after at least 10 microseconds. After this time, conductive channels in the gas have generally disappeared, and therefore a corona discharge can persist without transitioning into an arc discharge.

In order to prevent the corona discharge from transitioning into an arc discharge, the resonant circuit is excited with a slightly smaller secondary voltage after an arc discharge has been extinguished. After extinguishing the arc discharge the secondary voltage can be set to a lower value by reducing the primary voltage, for example. The new primary voltage is then smaller than the primary voltage at which previously an arc discharge was detected, for example 1% to 5% smaller.

If an arc discharge has been detected and in response thereto the secondary voltage been reduced, thus extinguishing the arc discharge, a corona discharge can be recreated in the same engine stroke. The fuel/air mixture in the combustion chamber of an engine can thus be ignited even after the prior malfunction of the corona ignition device.

In order to minimize the effects of an arc discharge, a corona discharge should be recreated as quickly as possible. With a method according to this disclosure the secondary voltage is increased again after a predefined period of time and a corona discharge is caused, for example by reactivating the high-frequency generator after a predefined period of time. It is also possible, for example, to determine by measurements whether the arc discharge has extinguished, and, if so, to increase the secondary voltage again and to thus create a corona discharge. In this case the electric variable is measured repeatedly even after the reduction of the secondary voltage and extinguishing of the arc discharge. By evaluating the measured values, it is then checked whether the arc discharge has been extinguished. If it is determined that the arc discharge has been distinguished the secondary voltage is reduced again and a corona discharge produced.

An arc discharge can be detected for example by analyzing the impedance of the resonant circuit of the corona ignition device. Further electric variables, on the basis of which it can be identified whether a corona discharge has transitioned into an arc discharge, include, inter alia, the resonance frequency of the resonant circuit, the phase shift between current and voltage, and the amperage in the resonant circuit.

The measured values of the electric variable can be analyzed, for example, by calculating a time derivative and comparing this with a predefined threshold value. In the event of a transition from a corona discharge into an arc discharge, the time derivative of the current is negative and falls below a predefined threshold value.

Another possibility is to compare the measured values of the electric variable with a predefined threshold value. By way of example, the transition of a corona discharge into an arc discharge can thus be identified on the basis of the fact that the amount of the electric current falls below a predefined threshold value.

The threshold value with which the measured values of the electric variable are compared can be predefined in absolute terms or can be determined as a function of values that have been measured during an earlier or the current engine cycle. For example, it can be concluded that an arc discharge has formed if the present value of the amperage deviates by more than a given amount, determined in absolute terms, from a maximum value previously measured in this engine cycle or engine stroke.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
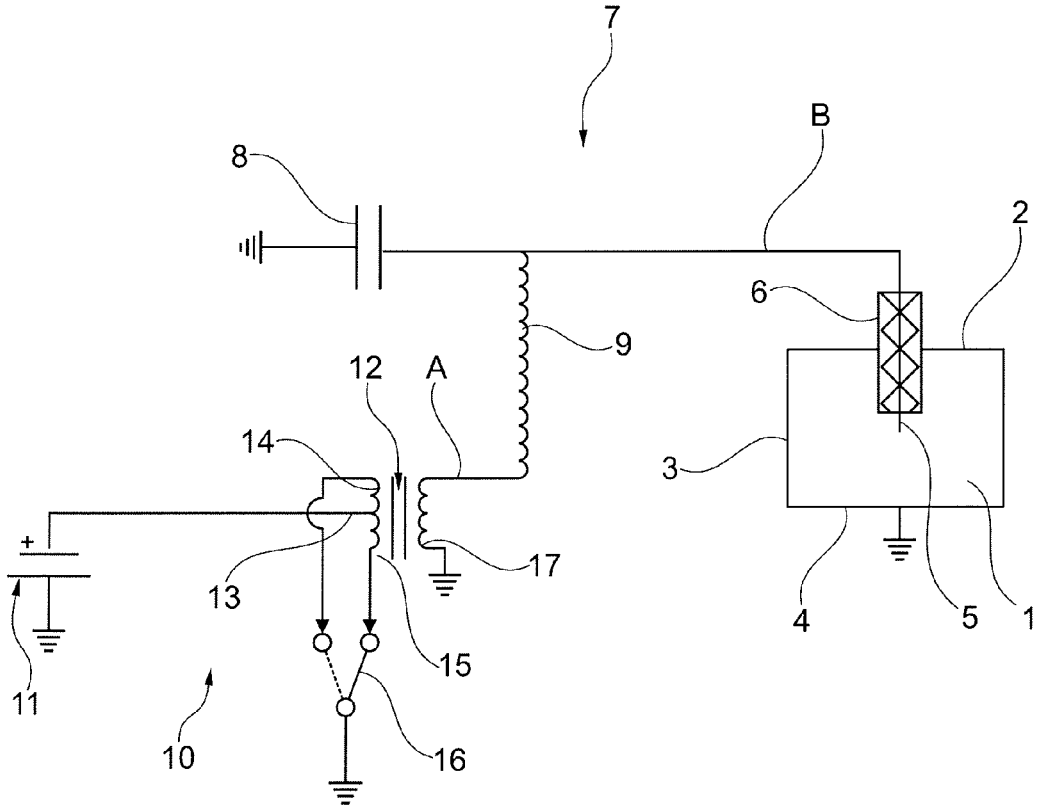
FIG. 1 shows a schematic illustration of an example of a corona ignition device.

FIG. 1 shows a combustion chamber 1 delimited by walls 2, 3 and 4, which are connected to ground. An ignition electrode 5 protrudes upwardly into the combustion chamber 1 and is surrounded over part of its length by an insulator 6, by means of which it passes in an electrically insulated manner through the upper wall 2 into the combustion chamber 1. The ignition electrode 5 and the walls 2 to 4 of the combustion chamber 1 are part of a series resonant circuit 7, which also comprises a capacitor 8 and an inductor 9. The series resonant circuit 7 may have further inductors and/or capacitors and other components, which are known to a person skilled in the art as possible components of series resonant circuits.

A high-frequency generator 10 is provided for exciting the resonant circuit 7. The high frequency generator 10 comprises a DC voltage source 11 and a transformer 12 with a center tap 13 on the primary side thereof, whereby two primary windings 14 and 5 meet at the center tap 13. The ends of the primary windings 14 and 15 distanced from the center tap 13 are connected alternately to ground by means of a high-frequency changeover switch 16. The switching frequency of the high-frequency changeover switch 16 determines the frequency with which the series resonant circuit 7 is excited and is variable. The secondary winding 17 of the transformer 12 feeds the series resonant circuit 7 at point A. The high-frequency changeover switch 16 is controlled by a control circuit (not illustrated) such that the resonant circuit is excited with the resonance frequency thereof. The voltage between the tip of the ignition electrode 5 and the walls 2 to 4 connected to ground is then at a maximum.

Figure 2:
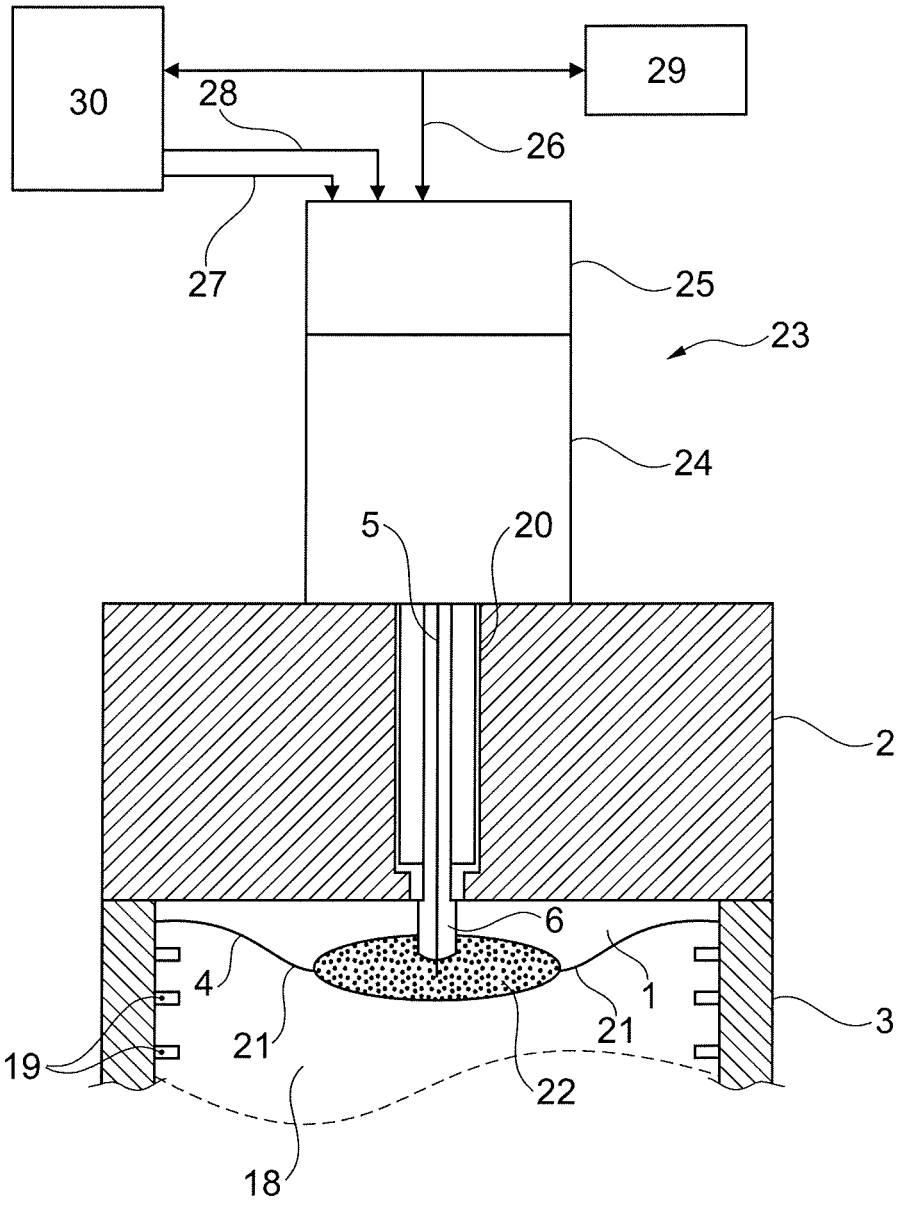
FIG. 2 shows a schematic illustration of a longitudinal section through a cylinder of an internal combustion engine with a corona ignition device.

FIG. 2 shows a longitudinal section through a cylinder of an internal combustion engine equipped with the ignition device illustrated schematically in FIG. 1. The combustion chamber 1 is delimited by an upper wall 2 provided as a cylinder head, by a cylindrical peripheral wall 3, and by the upper side 4 of a piston 18, which is movable to and fro in the cylinder and which is provided with piston rings 19.

A passage 20, through which the ignition electrode 5 is passed in an electrically insulated and sealed manner, is located in the cylinder head 2. The ignition electrode 5 is surrounded over part of its length by an insulator 6, which can be a sintered ceramic, for example of an aluminium oxide ceramic. The tip of the ignition electrode 5 protrudes into the combustion chamber 1 and protrudes slightly beyond the insulator 6, but could also terminate flush therewith.

Some sharp-edged protrusions 21 can be provided on the upper side of the piston 18 in the vicinity of the tip of the ignition electrode 5 to locally increase the electric field strength between the ignition electrode 5 and the piston 18 arranged opposite thereof. A corona discharge forms particularly in the area between the ignition electrode 5 and the optionally provided protrusions 21 of the piston 18 when the resonant circuit 7 is excited, and may be accompanied by a more or less intensive charge carrier cloud 22.

A housing 23 is fitted on the outer face of the cylinder head 2. The primary windings 14 and 15 of the transformer and the high-frequency circuit 16 cooperating therewith are located in a first portion 24 of the housing 23. The secondary winding 17 of the transformer 12 and the rest of the components of the series resonant circuit 7 and any means for observing the behavior of the resonant circuit 7 are located in a second portion 25 of the housing 23. For example, a connection to a diagnosis unit 29 and/or to an engine control unit 30 is possible via an interface 26.

In order to monitor the state of the corona ignition device, an electric variable is measured continuously. This electric variable may be, for example, the resonance frequency of the resonant circuit 7 or the amperage in the resonant circuit 7. The measured values of the electric variable are then analyzed in order to check whether or not an arc discharge is present.

The measured values of the electric variable can be analysed, for example, by calculating a time derivative and comparing this with a predefined threshold value. If the strength of the electric current in the resonant circuit is considered as the electric variable, the transition of a corona discharge into an arc discharge can be identified in that the electric current falls significantly, that is to say the time derivative of the current falls below a predefined negative threshold value. The measured value of the electric variable can also be analyzed by comparing it with a predefined threshold value. This threshold value can be predefined in a fixed manner or can be determined in dependence of values that have been measured during an earlier or the current engine cycle. For example, the transition of a corona discharge into an arc discharge can be identified on the basis of the fact that the difference between the momentary amperage and the maximum value of the amperage measured during this engine cycle exceeds a critical threshold value during the current engine cycle.

Figure 3:
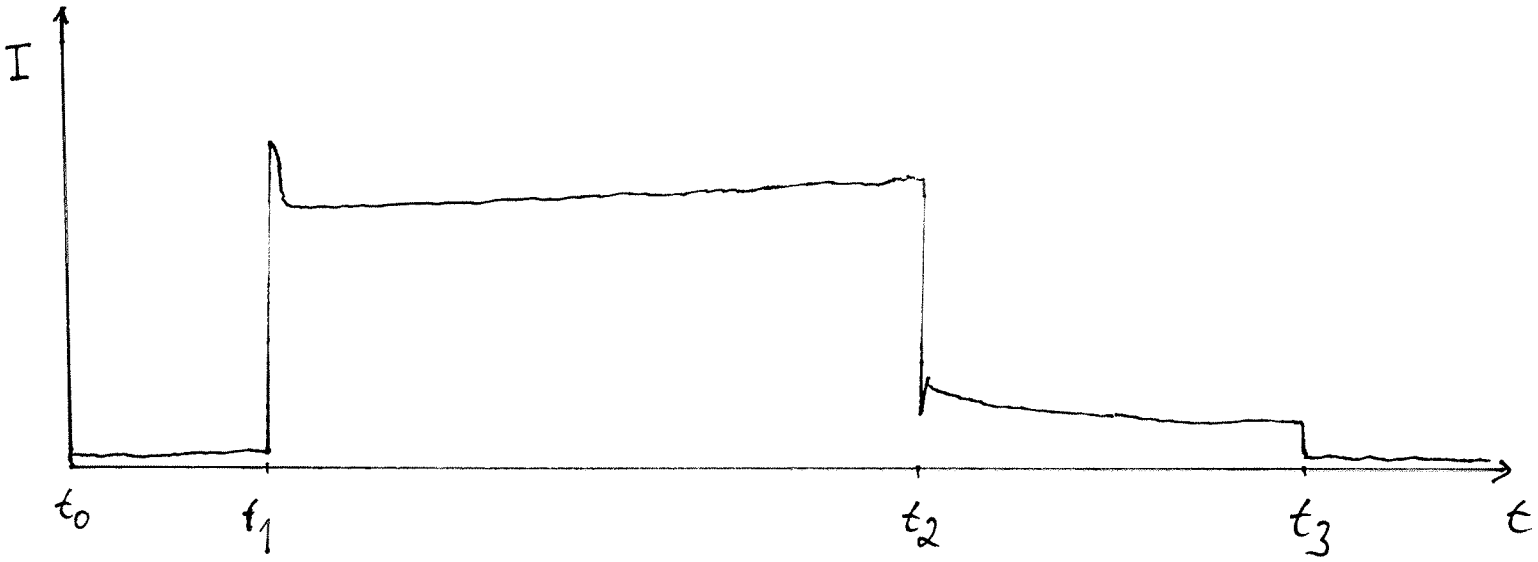
FIG. 3 shows an example for the profile of the absolute or effective value of the electric current on the secondary side of the high-frequency generator of a corona ignition device in the event of a corona discharge that transitions into an arc discharge.

For purposes of illustration, the electric amperage I is shown in FIG. 3 in random units as a function of time t. At the time $t_0$ the high-frequency generator 10 of the corona ignition device is switched off. The resonant circuit 7 is not excited, and the amperage I is therefore negligible. At the time $t_1$ the high-frequency generator 10 is switched on and the resonant circuit 7 is excited. As a result of this, the amperage I rises quickly and a corona discharge forms.

As a result of switch-on effects, a temporary superelevation of the amperage I may occur during the ignition of a corona discharge. Once switch-on effects have abated, the presence of a corona discharge is characterized by a largely stable electric amperage I. On the whole, the amperage during a corona discharge generally changes by less than 10%.

In the example illustrated in FIG. 3 the corona discharge transitions into an arc discharge at the time $t_2$. This transition is by a significant drop of the amperage I. At the time $t_3$ the high-frequency generator 10 is switched off. Thus the arc discharge is extinguished and the amperage I returns to the original negligible value.

In response to the detection of an arc discharge, the high-frequency generator 10 is switched off and thus the arc discharge extinguished as quickly as possible. The distance between the times $t_2$ and $t_3$ can thus be significantly reduced, for example, to less than 100 microseconds or even less than 50 microseconds. Once an arc discharge has been extinguished the high-frequency generator 10 is preferably switched on again only after a waiting period of 10 microseconds or more, so that there's sufficient time for conductive channels in gas to disappear or be interrupted before the ignition of a new corona discharge.

The high-frequency generator 10 can be switched off, for example, by terminating the actuation of the high-frequency changeover switch 16. Another possibility is to decouple the high-frequency generator 10 from the voltage source 11 or to quickly reduce the voltage of the voltage source 11. By switching off the high-frequency generator 10, the excitation of the resonant circuit 7 is terminated. This causes the secondary voltage at the ignition electrode 5 to fall quickly, and extinguishes the arc discharge.

With such a control method an arc discharge is extinguished as quickly as possible. The energy introduced into the combustion chamber of the engine on the whole by the arc discharge and the prior corona discharge is usually too low to cause an ignition of the fuel/air mixture in this engine cycle. If an arc discharge has been extinguished in an engine stroke by switching off the high-frequency generator 10, the high-frequency generator 10 is therefore switched on again in the same engine stroke, and a corona discharge is created again. The fuel/air mixture can thus still be ignited by a corona discharge in the current engine stroke in spite of the temporary malfunction of the corona ignition device, specifically the development of an arc discharge.

If an arc discharge is detected in an engine stroke and in response to this the high-frequency generator 10 is switched off, a corona discharge can be implemented by switching on again the high-frequency generator 10 after a predefined period of time. This period of time can be predefined in absolute terms, for example in microseconds, or can be defined in a relative manner as a function of the rotational speed of the engine. For example, the period of time can be predefined as an angle through which the crankshaft must have turned before the high-frequency generator 10 is switched on again. A further possibility is to continue measuring the electric variable after the high-frequency generator 10 has been switched off and, by analyzing the measured values, checking whether the arc discharge has extinguished. As soon as it has been determined that the arc discharge is extinguished, the high-frequency generator 10 can be switched on again. In this case, the high-frequency generator 10 is reactivated in response to detecting the discharge is no longer present, i.e., has been extinguished.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE NUMBERS 1. combustion chamber
2. wall of the combustion chamber
3. wall of the combustion chamber
4. wall of the combustion chamber, upper side of the piston 18
5. ignition electrode
6. insulator
7. resonant circuit, series resonant circuit
8. capacitor
9. inductor
10. high-frequency generator
11. DC voltage source
12. transformer
13. center tap
14. primary winding
15. primary winding
16. high-frequency changeover switch
17. secondary winding
18. piston
19. piston rings
20. passage
21. protrusions
22. charge carrier cloud
23. housing
24. first portion of 23
25. second portion of 23
26. interface
27. input
28. input
29. diagnosis unit
30. engine control unit

What is claimed is:

1. A method for controlling a corona ignition device having a high-frequency generator and a resonant circuit that contains an ignition electrode, the method comprising:

feeding a primary voltage into the high-frequency generator, exciting the resonant circuit by a secondary voltage generated by the high-frequency generator, and thereby creating a corona discharge at the ignition electrode;

measuring a series of values of an electric variable during the excitation of the resonant circuit;

analyzing the measured values to determine whether the corona discharge has transitioned into an arc discharge; and reducing the secondary voltage if an arc discharge is detected and thereby extinguishing the arc discharge;

wherein the method is carried out with a running engine, and, after the arc discharge has been extinguished, the secondary voltage is increased during the same engine cycle in which the arc discharge has been extinguished, and a corona discharge is thus recreated.

2. The method according to claim 1, wherein the method is carried out with a running engine and, after the arc discharge has been extinguished, the secondary voltage is increased during the same engine stroke in which the arc discharge was extinguished, and a corona discharge is thus recreated.

3. The method according to claim 1, wherein the secondary voltage is reduced by switching off the high-frequency generator.

4. The method according to claim 3, wherein the method is carried out with a running engine and, after the high-frequency generator has been switched off, the high-frequency generator is reactivated during the same engine cycle in which the high-frequency generator was switched off, and a corona discharge is thus recreated.

5. The method according to claim 4, wherein the primary voltage, after the high-frequency generator has been reactivated, is set to a value smaller than the value of the primary voltage at which an arc discharge was previously detected.

6. The method according to claim 1, wherein the measured values of the electric variable are analyzed by calculating a time derivative and comparing it with a predefined threshold value.

7. The method according to claim 1, wherein the measured values of the electric variable are compared with a predefined threshold value.

8. The method according to claim 1, wherein the measured values are compared with a threshold value that has been determined as a function of values measured during an earlier or the current engine cycle.

9. The method according to claim 1, wherein the electric variable is the electric current.

10. A method for controlling a corona ignition device having a high-frequency generator and a resonant circuit that contains an ignition electrode, the method comprising:

feeding a primary voltage into the high-frequency generator, exciting the resonant circuit by a secondary voltage generated by the high-frequency generator, and thereby creating a corona discharge at the ignition electrode;

measuring a series of values of an electric variable during the excitation of the resonant circuit;

analyzing the measured values to determine whether the corona discharge has transitioned into an arc discharge; and reducing the secondary voltage if an arc discharge is detected and thereby extinguishing the arc discharge, wherein the secondary voltage is reduced by switching off the high-frequency generator.

11. The method according to claim 10, wherein the method is carried out with a running engine, and, after the arc discharge has been extinguished, the secondary voltage is increased during the same engine cycle in which the arc discharge has been extinguished, and a corona discharge is thus recreated.

12. The method according to claim 10, wherein the method is carried out with a running engine and, after the arc discharge has been extinguished, the secondary voltage is increased during the same engine stroke in which the arc discharge was extinguished, and a corona discharge is thus recreated.

13. The method according to claim 10, wherein the method is carried out with a running engine and, after the high-frequency generator has been switched off, the high-frequency generator is reactivated during the same engine cycle in which the high-frequency generator was switched off, and a corona discharge is thus recreated.

14. The method according to claim 13, wherein the primary voltage, after the high-frequency generator has been reactivated, is set to a value smaller than the value of the primary voltage at which an arc discharge was previously detected.

15. The method according to claim 10, wherein the measured values of the electric variable are analyzed by calculating a time derivative and comparing it with a predefined threshold value.

16. The method according to claim 10, wherein the measured values of the electric variable are compared with a predefined threshold value.

17. The method according to claim 10, wherein the measured values are compared with a threshold value that has been determined as a function of values measured during an earlier or the current engine cycle.

18. The method according to claim 10, wherein the electric variable is the electric current.

* * * * *